US009345920B2

(12) United States Patent
Seroussi et al.

(10) Patent No.: US 9,345,920 B2
(45) Date of Patent: May 24, 2016

(54) FITNESS HOOP HAVING VARIABLE IMPACT FORCE

(71) Applicants: Karyn Seroussi, Greaker (NO); Jorgen Klaveness, Greaker (NO)

(72) Inventors: Karyn Seroussi, Greaker (NO); Jorgen Klaveness, Greaker (NO)

(73) Assignee: INNERSVINGEN AS, Greaker (NO)

( * ) Notice: Subject to any disclaimer, the term of this patent is extended or adjusted under 35 U.S.C. 154(b) by 0 days.

(21) Appl. No.: 13/936,828

(22) Filed: Jul. 8, 2013

(65) Prior Publication Data

US 2015/0018175 A1 Jan. 15, 2015

(51) Int. Cl.

| | |
|---|---|
| ***A63B 21/22*** | (2006.01) |
| ***A63B 19/00*** | (2006.01) |
| ***A63B 21/06*** | (2006.01) |

(52) U.S. Cl.

CPC ..... *A63B 19/00* (2013.01); *A63B 21/0608* (2013.01); *A63B 2209/00* (2013.01)

(58) Field of Classification Search

CPC ..... A63B 19/00; A63B 19/02; A63B 19/04; A63B 21/015; A61H 2201/1678; A61H 2205/088

USPC ..... 482/78, 110, 131, 132, 139, 148; 446/26–28, 236

See application file for complete search history.

(56) References Cited

U.S. PATENT DOCUMENTS

| | | | | |
|---|---|---|---|---|
| 4,052,982 | A * | 10/1977 | Ozeryansky | 601/121 |
| 6,309,273 | B1 * | 10/2001 | Kim | 446/28 |
| 6,319,086 | B1 * | 11/2001 | Shen | 446/236 |
| 6,712,779 | B1 * | 3/2004 | Iverson | 601/134 |
| 7,303,458 | B1 * | 12/2007 | Wolfinbarger | 446/236 |
| 2008/0220691 | A1 * | 9/2008 | Kim | 446/236 |
| 2009/0017719 | A1 * | 1/2009 | Lin | 446/236 |

* cited by examiner

*Primary Examiner* — Stephen Crow
*Assistant Examiner* — Gregory Winter
(74) *Attorney, Agent, or Firm* — Sughrue Mion, PLLC; Richard C. Turner

(57) ABSTRACT

An exercise device including a hoop made primarily of two elements, a softer inner element and a more rigid outer element. The inner element of the hoop has a plurality of shock absorbing compression chambers projecting inwardly and formed on an inner diameter thereof. The plurality of chambers each have a convex shape formed by a plurality of ribs connected by a connecting member. The chambers are formed at an angle with respect to a diameter of the hoop and have different compression attributes when the hoop is rotated by and about the user's body in the two different possible rotational directions. In this manner, the hoop will require greater exertion to maintain rotation in one direction versus the other, and also, the impact force which the hoop exerts on the user's skin will also differ depending upon the rotation direction.

7 Claims, 5 Drawing Sheets

FITNESS HOOP HAVING VARIABLE IMPACT FORCE

BACKGROUND OF THE INVENTION

1. Field of the Invention

The present invention relates to a fitness hoop, and more particularly, to a weighted fitness hoop used for exercise.

2. Background Art

Hoops have been used by children as toys for several decades. Hoops of this type are typically comprised of a hollow or filled tube formed into a circular ring-shape, e.g., a hula hoop.

In recent years, hoops have been used for exercise purposes. Fitness hoops are often weighted in order to improve the exercise effect through increased muscle activation. This added weight to the hoop may be accomplished by filling the hoop with a heavy material, such as water, or by manufacturing the hoop from a heavy material.

While an impact force created by the weighted fitness hoop is desirable to activate the user's muscles, one problem that occurs with typical weighted fitness hoops is that the impact force often leads to discomfort for the user. For example, with typical weighted fitness hoops, the user may often receive bruising from the high pressure and impact force against the user's skin. For the designer of an fitness hoop, the challenge is to find an optimal balancing point between these forces Many attempts have been made by others to reduce the pressure of weighted fitness hoops on the skin while also maintaining the hoop's ability to activate the user's muscles. As an example, certain weighted fitness hoops have decreased the overall weight of the hoop such that the pressure exerted on the skin is diminished and the chances of bruising are decreased. Decreasing the weight of the fitness hoop, however, also decreases the fitness hoop's ability to activate the muscles, and thus, its effectiveness.

Some designers of fitness hoops have added a sleeve of high-density foam rubber to cushion the user, but this is too easily compressed and therefore not very effective. In addition, the foam covering is subject to cuts and tears when the hoop comes in contact with walls, chairs, or other objects.

Other attempts have been made to reduce pressure on the skin by increasing the surface area of the fitness hoop. By spreading the force of the fitness hoop over a larger surface area, the pressure exerted on the user's skin can be reduced. These devices have been relatively unsuccessful because an increase in the surface area of the fitness hoop naturally results in increased weight of the fitness hoop. Some designers have tried to work around this problem by flattening the hoop, shaping it more like a belt than a circular tube. This approach increases the inside surface area more than it increases the weight of the hoop.

There is known in the prior art a number of fitness hoops in which the shape has a wavy inner circumference. Contrary to conventional hoops, fitness hoops with a wavy inner circumference do not strike the same part of the body with the same force on each revolution. Since the wavy fitness hoop strikes the body with maximum force at different locations on each revolution, the maximally impacted areas of the user's body are given more time to recover before the next impact. To date, fitness hoops with wavy inner circumferences still however can cause bruising, especially for beginners. Depending upon the exact shape, wavy hoops can load the skin surface with a significantly higher force per unit area than the conventional hoop shape. This is exacerbated with an increased weight of the fitness hoop or with hard materials.

Consequently, it is desirable to produce a weighted fitness hoop that can be used for exercise that reduces bruising or does not bruise the user during use, and does not have unnecessary added weight that increases the fitness hoop's impact on the user's body.

SUMMARY OF THE INVENTION

This invention provides a fitness hoop which can address one or more of the problems described above. The fitness hoop according to the invention includes a cushioning system which can act as a guard against the development of overly large impact forces, and which is further designed such that the degree of impact force imparted is different with the direction of revolution of the hoop about the body. This is especially useful for beginners since they can employ the hoop rotating in one direction when beginning an exercise regimen, and after their bodies have adapted to the impact force developed by the hoop, they can simply reverse the rotation direction of the hoop or equivalently flip the hoop over for a more vigorous exercise routine with a higher impact force.

DETAILED DESCRIPTION OF THE INVENTION

In the following detailed description, reference will be made to the accompanying drawing(s), in which similar elements are designated with similar numerals. The aforementioned accompanying drawings show by way of illustration and not by way of limitation, specific implementations consistent with exemplary embodiments. These implementations are described in sufficient detail to enable those skilled in the art to practice an the invention, and it is to be understood that other implementations may be utilized and that structural changes and/or substitutions of various elements may be made without departing from the scope and spirit of the invention. The following detailed description is, therefore, not to be construed in a limiting sense.

Figure 1:
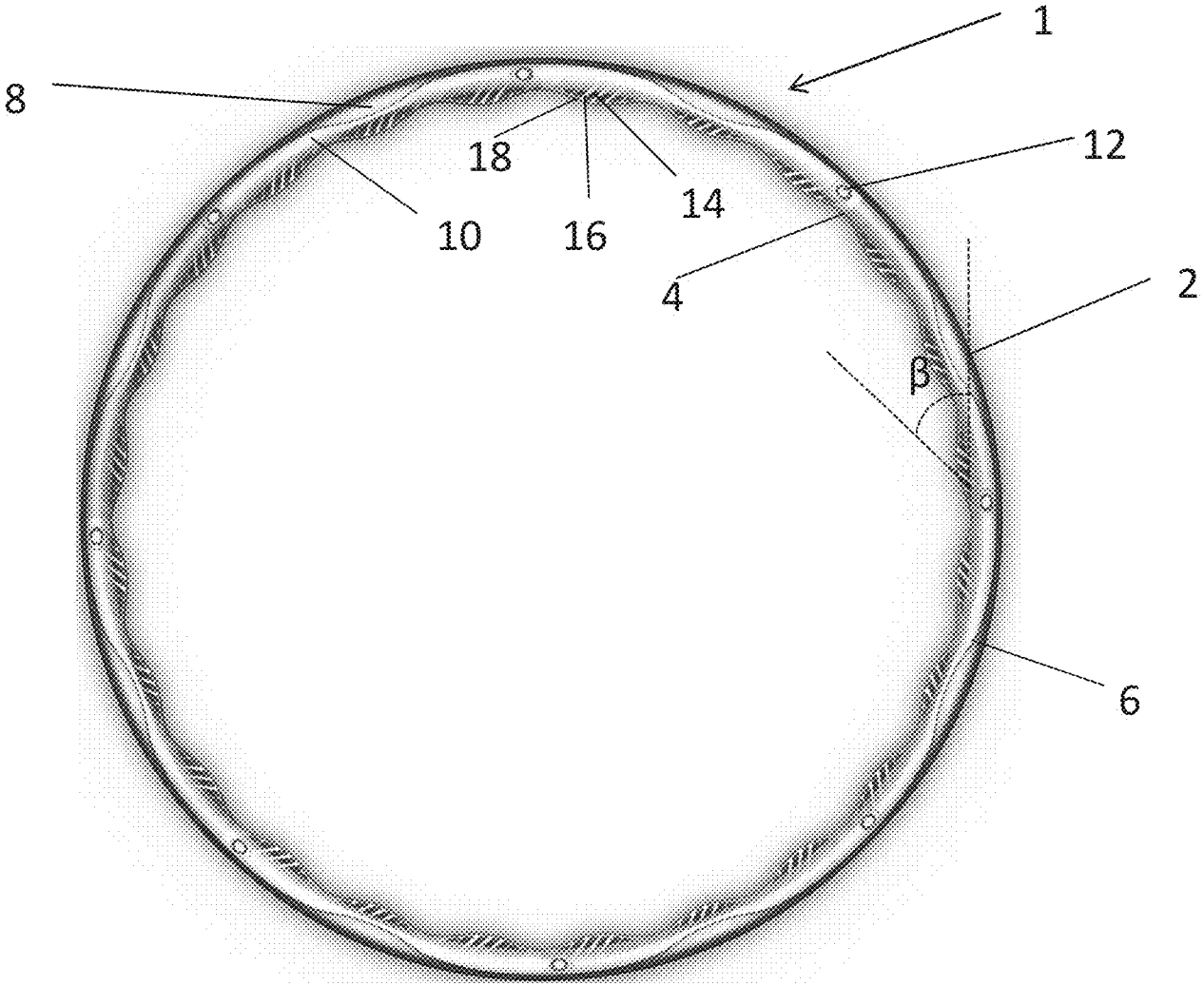
FIG. 1 is a top plan view of the fitness hoop.
Figure 2:
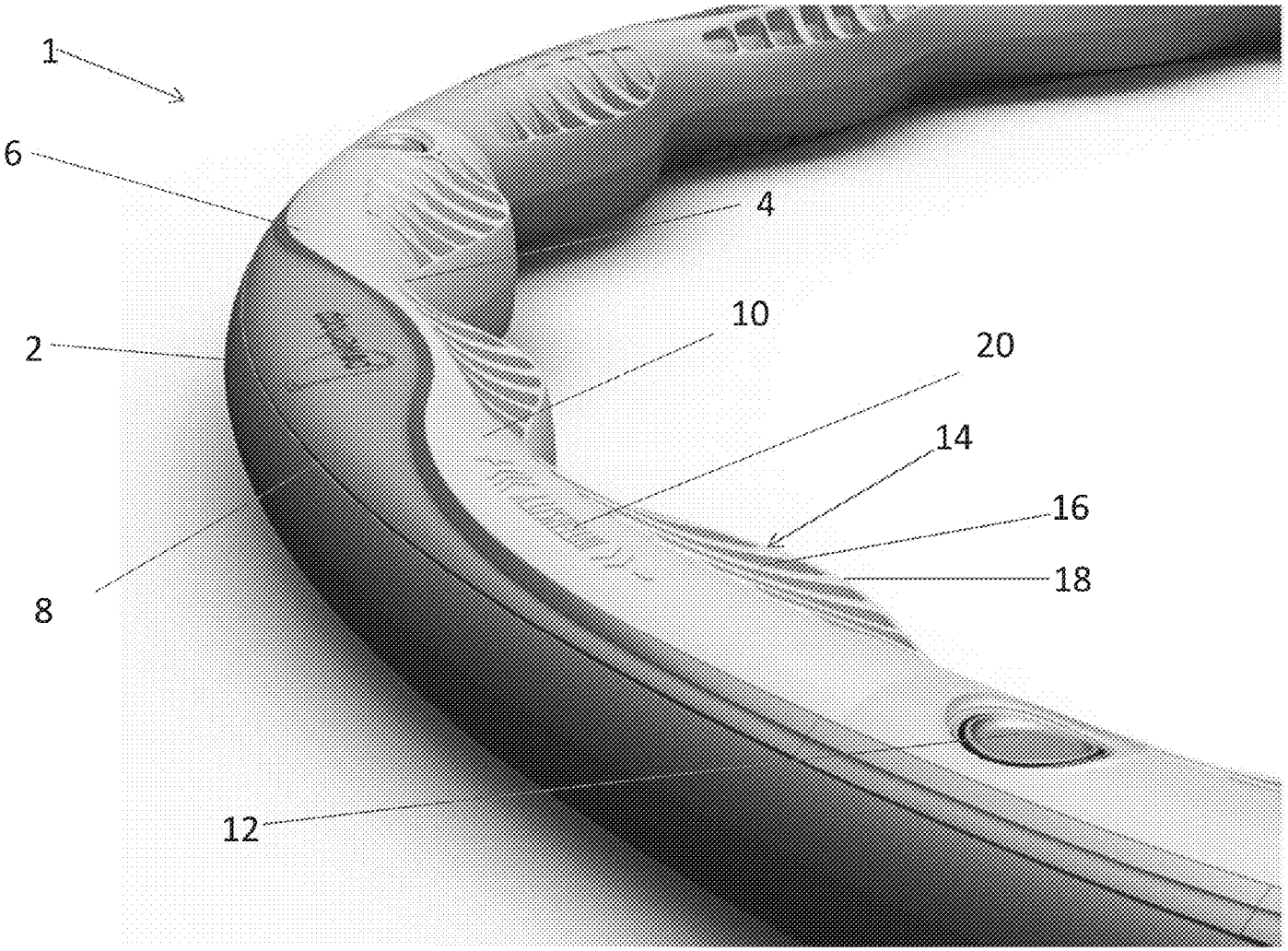
FIG. 2 is an enlarged perspective view of a portion of the fitness hoop.
Figure 5:
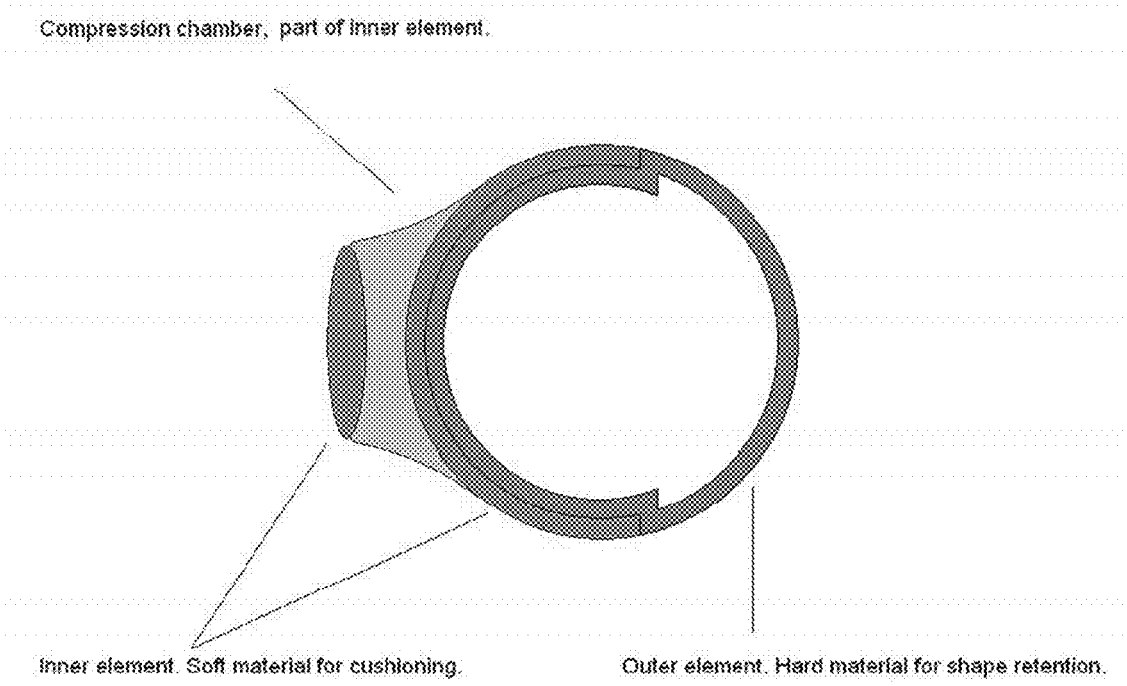
FIG. 5 is a cross-sectional view through the fitness hoop

FIG. 1 illustrates a first exemplary embodiment of the instant application. The exercise device is in the form of a hoop 1 with a ring-shape. The hoop 1 has an outer surface 2 and an inner surface 4. According to one embodiment, the hoop has a circular shape, but this the shape is not limiting and the hoop 1 may be of other shapes. The hoop 1 has a plurality of open chambers 14, or shock-absorbing compression chambers, formed on the inner surface 4. The chambers 14 project outwardly from the inner surface 4, thus forming a wavy pattern on the inner surface 4 of the hoop. The inner surface 4 contacts the user while the hoop 1 is being used. The outer surface 2 of the hoop 1 has a smooth, tubular shape; however, this shape is not limiting and may be designed as desired. The hoop 1 is composed of an hard outer element 8, that gives the hoop its shape, and a softer inner element 10 that contains the compression chambers. Both of these have a general ring shape, as shown in FIG. 1. The outer element 8 and inner element 10 may be bonded together using a "dual shot" injection molding process. This molding technique is generally known in the art; see for example http://www.aimplastic-s.com/two-shot.php. Heat provided by the dual shot injection process bonds the inner element 10 to the outer element 8 to form the hoop 1 as shown in FIGS. 1 and 2. When the inner element 10 and outer element 8 are bonded, the outer surface 2 of the outer element 8 is exposed. In a non-limiting embodiment, when the inner element 10 and the outer element 8 are bonded together they form a ring shaped tube 6 of hoop 1 together having a circular shape with an outer diameter of approximately 102 cm. As shown in FIG. 1, in a non-limiting embodiment, the tube 6, including the outer element 8 and inner element 10, may have different cross-sectional diameters and shapes at different points along the perimeter or circumference. FIG. 5 shows an example of a typical cross section.

The hoop 1 has an inner diameter defined by the inner surface 4 of approximately 95 cm. This size is not limiting, however, and the hoop may be manufactured in varying sizes.

In a non-limiting embodiment, the outer element 8, including the outer surface 2, is made of a hard plastic that gives the hoop 1 its rigidity. Further, in a non-limiting embodiment, the inner element 10, including the inner surface 4 and the plurality of inwardly extending chambers 14, may be made of more flexible material, such as a synthetic rubber. For example, a thermoplastic elastomer (TPE) may be used. Use of a material that is slightly flexible allows the hoop to maintain its shape without becoming excessively heavy or rigid, as would occur if a hard or brittle plastic were used. Different embodiments may vary the size, material, or color of the outer element 8, inner element 10, outer surface 2, and inner surface 4 depending on the design.

As mentioned above and as further illustrated in FIG. 3, the inner element 8 includes the plurality of chambers 14 projecting inwardly in a counter clockwise direction such that the inner surface 4 of the hoop 1 has a convex/concave wavy shape. Each chamber 14 has a generally convex shape with a plurality of ribs 16. The ribs 16 have different lengths according to their position along the convex shape of the chamber. That is, the ribs 16 on the ends of the chamber are shorter than the ribs towards the center of the chamber 14. Thus, moving from the outermost ribs to the innermost ribs 16, the ribs 16 increase in size so that the chamber 14 has a continuous, convex shape.

Figure 3:
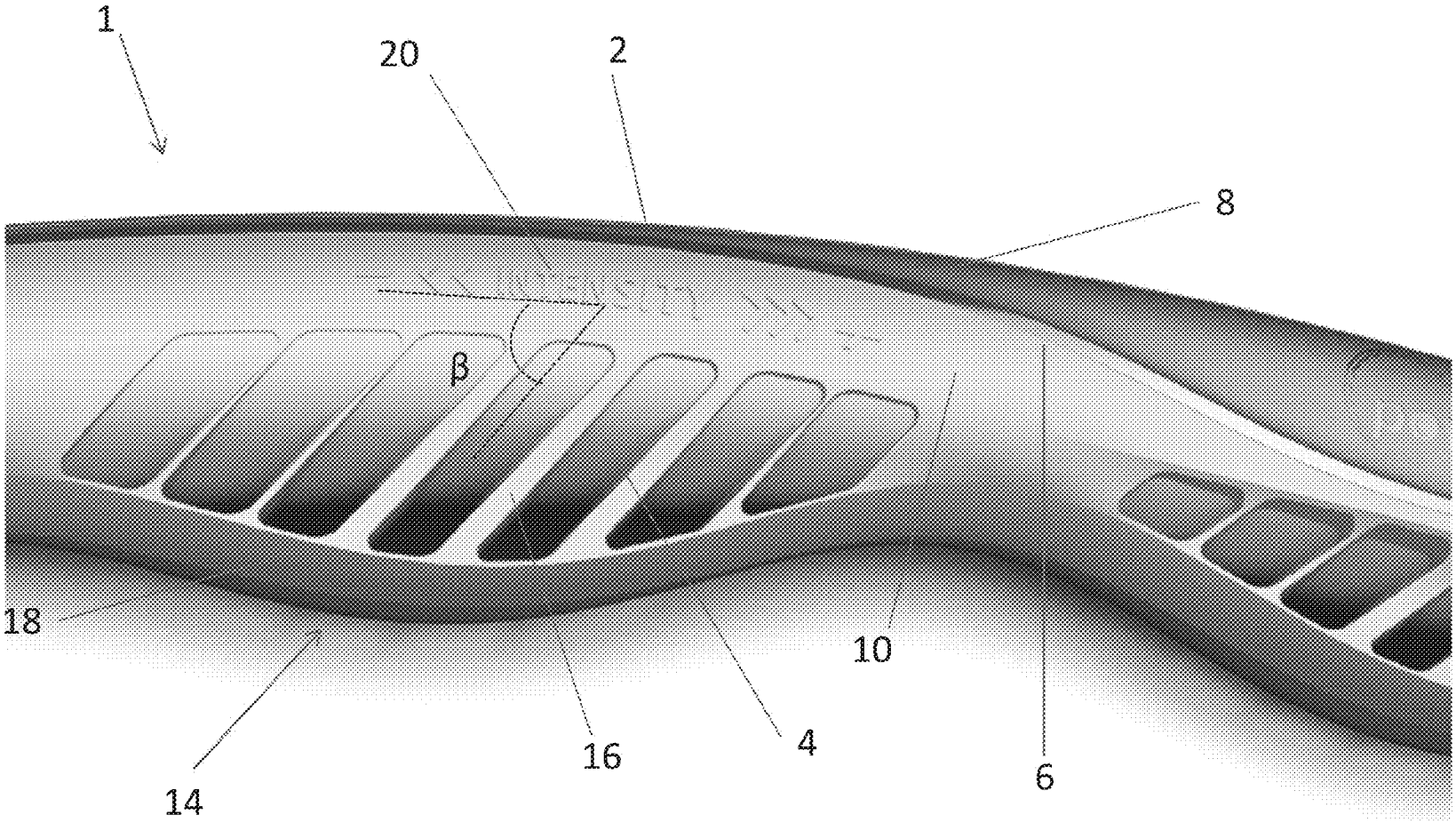
FIG. 3 is an enlarged top plan view of the fitness hoop.

In a non-limiting embodiment, the ribs 16 project inwardly in a counter clockwise direction at a projection angle β. The angle β is defined as an angle between a center line of the rib and a line tangential to a center line of the circumference of the hoop as shown in FIG. 3. The projection angle may be less than 90° as shown in FIG. 3, and is preferably 45 to 60 degrees. In a non-limiting embodiment, all of the ribs in each chamber have the same projection angle β. Likewise, all of the chambers project inwardly at relatively the same projection angle. The projection angle of the ribs is not limiting.

A chamber top layer 18, as an example of a connecting member, connects the plurality of ribs as shown in FIG. 3. The chamber top layer 18 is designed to contact the user's body while the hoop 1 is being used. The surface of the chamber top layer 18 that contacts the user's skin is flat rather than rounded as in the interior surface of a conventional fitness hoop. The flattened surface of the chamber top layer 18 increases the area of contact with the skin, and thus, decreases the pressure exerted on the skin.

The chamber 14 is designed to reduce the pressure on the user's skin while maintaining the weight and desirable impact of the hoop 1. To prevent excess weight, in a non-limiting embodiment the chambers 14 are made from a synthetic rubber. Because synthetic rubber is softer than hard plastic, its presence in the chamber 14 helps to reduce pressure on impact. This choice of material, however, is not particularly limiting and a variety of materials may be chosen depending on the design.

While the hoop 1 is in use, the chamber top layer 18 of the chamber 14 will contact the user's skin. The intensity of the contact is a result of the centripetal force, which depends on the hoop's weight, its diameter, its speed of rotation, and the variable acceleration caused by the variable geometry of the user's body and the user's movements. For a typical user spinning a 1.7 kg hoop, the centripetal force will tend to be in the size order of 4-8 kg. The ribs 16 have therefore been designed so that they are fully compressed with a force of approximately 8 kg. At this amount of compression, there will be no air left in the compression chamber, and the top layer 18 will be lying flat, in contact with the material underneath. The amount of compression, and thus, the shock absorption capability of the chambers 14 will vary depending on the projection angle β of the ribs because it is the angle at which the ribs 16 support the top layer 18 as it contacts the user's skin. For example, ribs 16 with projection angles closer to 90° degrees will compress less than ribs 16 with lower projection angles, leading to a stronger impact.

In a non-limiting embodiment, where the projection angle β is not equal to 90°, the chambers 14 will compress less and be more rigid and stiffer when the hoop 1 is rotating in a clockwise direction, against the ribs, as opposed to when the hoop 1 is rotating in a counter clockwise direction along with the projection angle of the ribs. Thus, in this non-limiting embodiment, the user has the options to rotate the hoop 1 in a counter clockwise direction for a lower pressure level exerted on the user's skin or in a clockwise direction for a higher pressure level exerted on the user's skin. That is, the user has the ability to choose their preferred impact level by selecting between two shock absorption possibilities.

As shown in FIG. 3, the hoop 1 may include an intensity direction label 20 which informs the user which direction, clockwise or counter clockwise, the user should rotate the hoop 1 for more or less intense exercise. In this non-limiting embodiment, the user may choose between a higher impact exercise or a lower impact exercise by rotating the hoop 1 in either a clockwise (for high impact) or counter clockwise direction (for lower impact).

When the compression chamber 14 is flattened, the deformation is not going to be completely elastic. Some of the energy that goes into deforming the rubber during the compression phase, will not be released again during decompression, but will be retained. This will have the effect of slowing down the hoop, and requiring that the user spends additional muscle energy in order to maintain the rotation of the hoop 1, resulting in a more intense aerobic component to the exercise. The magnitude of this effect will depend on the direction of rotation.

The discussion above refers to the hoop in the orientation it has in FIG. 1, with the ribs and chambers projecting inwardly in a counterclockwise direction. If the hoop is turned upside down, the ribs and chambers will project inwardly in a clockwise direction. When oriented this way, the hoop 1 needs to be rotated in a clockwise direction for a lower impact exercise.

Figure 4:
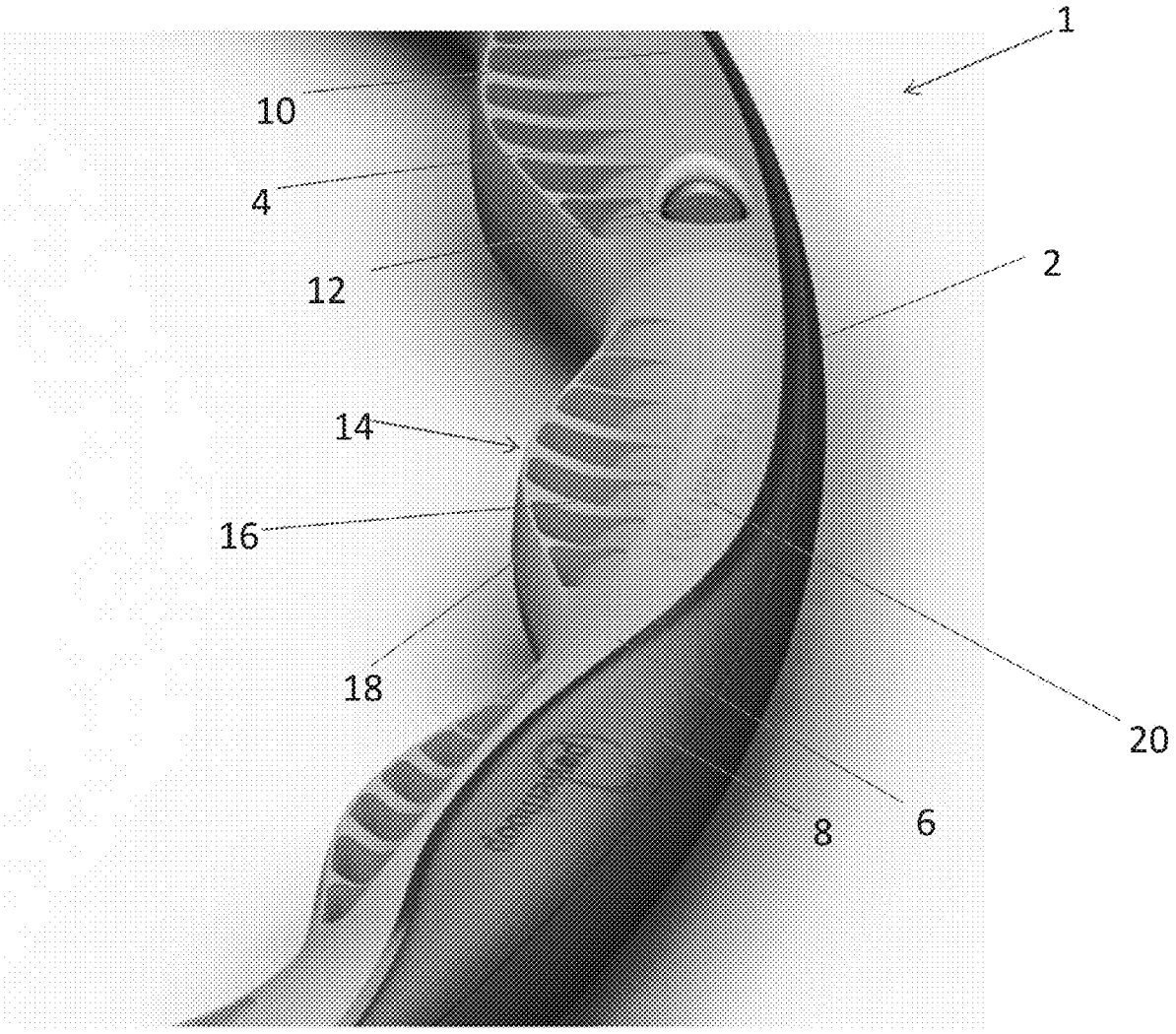
FIG. 4 is an enlarged perspective view of a portion of the fitness hoop.

As shown in FIG. 4, the hoop may be formed as a series of segments which are connected by means of a connection/fastener arrangement operated by means of buttons 12. In this way, the hoop can be deconstructed for portability. The fastener arrangement per se is known in the art and thus not described here in detail.

What is claimed is:

1. An exercise device comprising:

a hoop comprising an inner element and an outer element which is more rigid than said inner element, the inner element of the hoop having a plurality of chambers projecting inwardly and formed on an inner diameter thereof, and the hoop being configured to be rotated around a body part of a user, wherein:

the hoop is configured to rotate in a clockwise direction for a more intense exercise, and the hoop is configured to rotate in a counter clockwise direction for a less intense exercise, and wherein the intensity of the exercise depends at least in part upon an amount of force required to compress said chambers when a compressive force is applied from different angles, said different angles corresponding, respectively, to the hoop rotating around said body part in said clockwise and counter clockwise directions; and wherein the plurality of chambers each have a convex shape formed by a plurality of ribs connected by a connecting member, and each rib projects inwardly of the hoop at a projection angle which is less than ninety degrees and thereby makes an acute angle with a radius of said hoop.

2. The exercise device according to claim 1, wherein the outer element of the hoop is composed of a hard plastic material formed in a circular ring shape.

3. The exercise device according to claim 1, wherein the inner element and chambers are made from a flexible material.

4. The exercise device according to claim 1, wherein the inner element is bonded to the outer element using a dual shot injection molding process.

5. The exercise device according to claim 4, wherein the hoop is composed of a number of segments which are detachable from one another to promote portability of the hoop.

6. The exercise device according to claim 1, further comprising a label fixed to an outer surface of said hoop and indicating said more intense exercise rotation direction and said less intense exercise rotation direction.

7. A method of using an exercise device, comprising:

providing the exercise device of claim 1;

rotating the hoop around the body part of the user, and further comprising:

rotating the hoop in the clockwise direction for the more intense exercise; and rotating the hoop in the counter clockwise direction for the less intense exercise.

* * * * *